US006160956A

United States Patent [19]

Pelonis

[11] Patent Number: 6,160,956

[45] Date of Patent: Dec. 12, 2000

[54] CEILING FAN WITH HEATING/LIGHTING ASSEMBLY

[76] Inventor: Kosta L. Pelonis, c/o Pelonis USA Ltd., 103 Great Valley Pkwy., Great Valley Corporate Center, Malvern, Pa. 19355

[21] Appl. No.: 08/931,274

[22] Filed: Sep. 15, 1997

Related U.S. Application Data

[63] Continuation-in-part of application No. 08/587,378, Jan. 17, 1996, Pat. No. 5,668,920.

[51] Int. Cl.[7] ..... F24H 3/02

[52] U.S. Cl. ..... 392/361; 392/364; 416/5

[58] Field of Search ..... 392/361, 364–367; 416/5, 95; 165/122, 125

[56] References Cited

U.S. PATENT DOCUMENTS

| | | |
|---|---|---|
| 1,798,290 | 3/1931 | Winner et al. . |
| 2,044,832 | 6/1936 | Child . |
| 2,267,425 | 12/1941 | Rowe et al. . |
| 3,176,117 | 3/1965 | Knoll et al. . |
| 3,223,828 | 12/1965 | Mast . |
| 4,034,204 | 7/1977 | Windsor et al. . |
| 4,146,776 | 3/1979 | Johanson . |
| 4,342,073 | 7/1982 | Ranten . |
| 4,402,649 | 9/1983 | Laurel . |
| 4,504,191 | 3/1985 | Brown . |
| 4,508,958 | 4/1985 | Kan et al. . |
| 4,526,227 | 7/1985 | Baker . |
| 4,560,909 | 12/1985 | Peil . |
| 4,681,024 | 7/1987 | Ivey . |
| 4,694,142 | 9/1987 | Glucksman . |
| 4,782,213 | 11/1988 | Teal . |
| 4,831,505 | 5/1989 | Van Norman . |
| 5,028,206 | 7/1991 | Kendregan et al. . |
| 5,072,341 | 12/1991 | Huang . |
| 5,077,825 | 12/1991 | Monrose . |
| 5,079,684 | 1/1992 | Lai . |
| 5,245,692 | 9/1993 | Kawai . |
| 5,302,083 | 4/1994 | Bucker et al. . |
| 5,333,235 | 7/1994 | Ryder . |
| 5,421,701 | 6/1995 | Funston . |
| 5,425,126 | 6/1995 | Lee . |
| 5,440,459 | 8/1995 | Chan . |
| 5,454,692 | 10/1995 | Davis . |
| 5,655,877 | 8/1997 | Yu . |
| 5,668,920 | 9/1997 | Pelonis ..... 392/361 |

FOREIGN PATENT DOCUMENTS

| | | |
|---|---|---|
| 828757 | 1/1952 | Germany . |
| 5272810 | 10/1993 | Japan . |
| 873047 | 7/1961 | United Kingdom . |

*Primary Examiner*—Tu Ba Hoang
*Attorney, Agent, or Firm*—Paul & Paul

[57] ABSTRACT

A ceiling fan is equipped with a heating/lighting assembly, mounted below the fan blades. The heating lighting assembly has a circular, annular housing which extends radially outwardly of the motor, and in which are mounted resistive heating elements and tubular, circular fluorescent tube. The heating/lighting assembly provides both heat and light in an efficient, effective and comfortable manner.

20 Claims, 1 Drawing Sheet

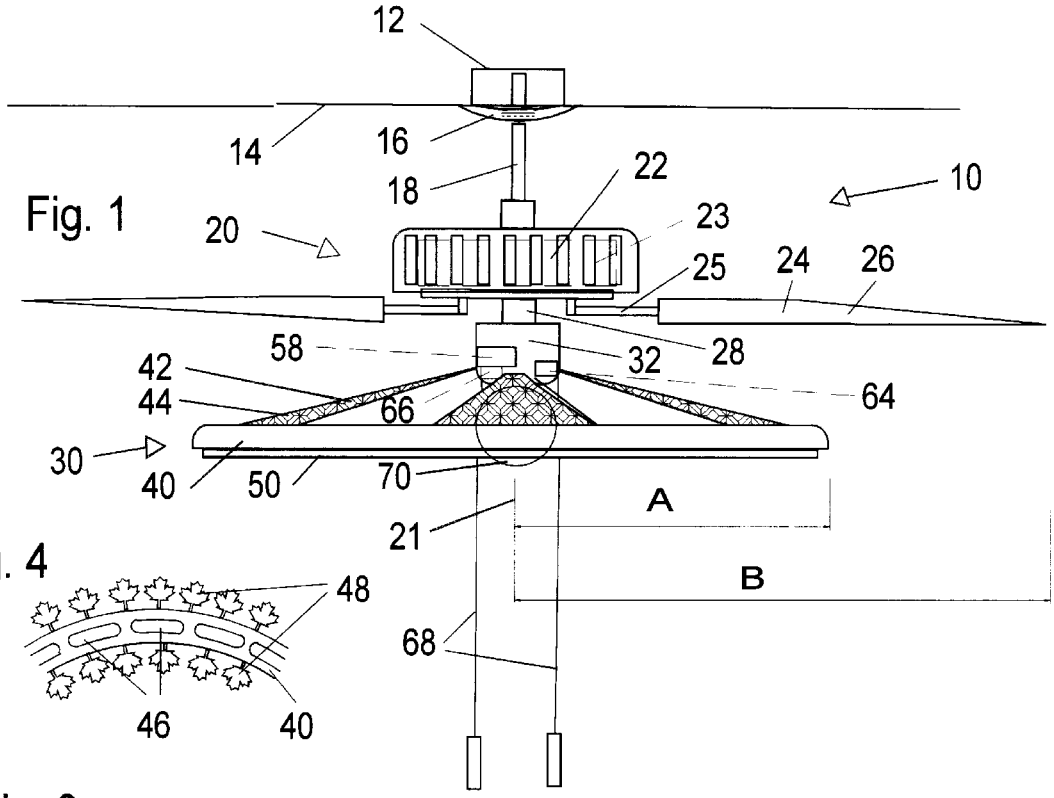
Fig. 1
Fig. 4
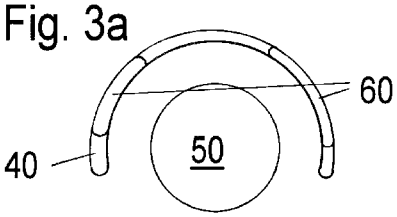
Fig. 3a
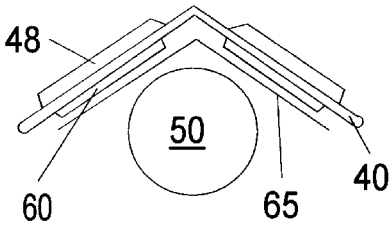
Fig. 3b
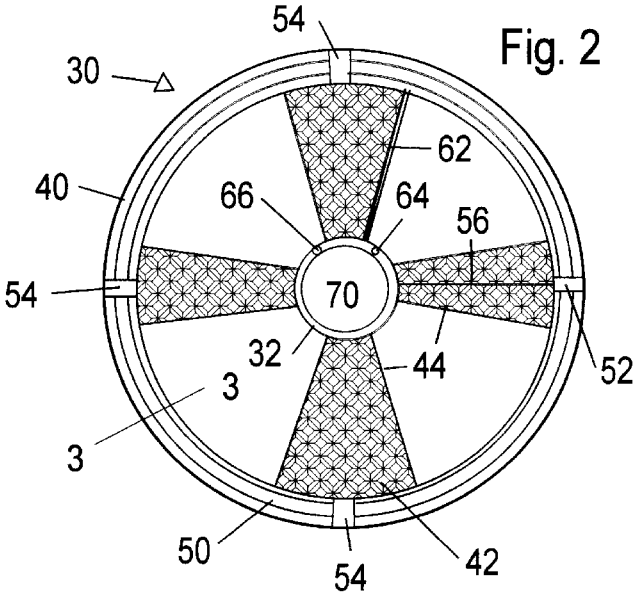
Fig. 2

CEILING FAN WITH HEATING/LIGHTING ASSEMBLY

CROSS-REFERENCE TO RELATED APPLICATION

This application is a continuation-in-part of U.S. patent application Ser. No. 08/587,378 filed Jan. 17, 1996 now U.S. Pat. No. 5,668,920.

BACKGROUND OF THE INVENTION

1. Field of the Invention

The present invention relates to ceiling fans and more particularly ceiling fans including heaters, and heater and lighting attachments for ceiling fans.

2. Brief Description of the Prior Art

Ceiling fans are well known as effective means for circulating air in enclosed spaces. They are employed chiefly in warm weather conditions for cooling and ventilating rooms. The fans, which are typically centered in the ceiling of a room, employ relatively large blades (for example, about one half meter in length) circulating at low speeds (for example, about 130 rpm), and are typically operated to push air downward in the center of the room, the air returning to the fan proximate the walls and ceiling of the room. Because ceiling fans are typically operated at low speeds, they operate quietly, which is very desirable for the room's occupants.

While ceiling fans are used almost exclusively under warm conditions, they are also of potential value in cool and cold weather, when enclosed spaces must be heated. Since hot air rises, rooms tend to be heated from the top down, lengthening the discomfort endured by their occupants from the cold, particularly when ceilings are high. This is also wasteful of energy, because the upper portion of a room is not occupied. Because they tend to bring air close to the ceiling of a room down towards the center of the room, ceiling fans can increase the comfort of occupants of cold rooms while they are being heated through their circulation of the room's air, and reduce energy costs. On the other hand, the slight draft they create, so pleasant on a sultry day, may have the opposite effect on a cold one. Further, when heated, the fan blades tend to warp, destroying the fan's balance and aesthetic appeal.

A number of efforts have been made in the prior art to provide ceiling fans themselves with means for heating the room. One popular direction, exemplified in U.S. Pat. Nos. 4,782,213 and 4,504,191 has been to attempt to fit the fan blades themselves with heating elements. This has the inherent difficulty of requiring moving electrical contacts for the heater circuits, which must carry a relatively large current if they are to effectively heat the room. A further difficulty lies in the proximity of the fan blades to the ceiling, which tends to promote heat loss to the ceiling.

A second approach has been to mount heating elements in the vicinity of the fan blades, so that air to be heated is drawn or pushed over the heating elements. This second approach, which is exemplified in U.S. Pat. Nos. 5,077,825, 5,333,235, and 5,425,126, also inherently suffers from a number of serious drawbacks.

If the heating elements are mounted below the fan blades, such as in U.S. Pat. Nos. 5,077,825 and 5,333,235, aesthetics and consumer acceptance have suggested in the past that they be near the fan's rotational axis. However, in this case the ceiling fan motor immediately above them must be provided with substantial thermal protection. Further, the air flow from the rotating blades is minimal proximate the rotational axis, limiting heat transfer from the heating elements to the circulating air. These factors substantially limit the amount of heat that can be safely provided.

Conversely, if the heating elements are disposed above the fan blades, such as in U.S. Pat. No. 5,425,126, not only the fan motor, but also the ceiling, must be thermally insulated from the heating elements. In the device shown in the '126 patent the fan is operated backwards, blowing air up over the heating elements. Unless special arrangements are otherwise made, circulating air in this way will wastefully heat the ceiling and walls before the center of the room. Thus, in the '126 device the heated air is pushed through a set of tubes arranged to spill the heated air just outside and below the radial sweep of the ceiling fan blades, so that the heated air is delivered to the center of the room. However, these tubes give the device an unconventional appearance, reducing consumer acceptance.

Light kits for ceiling fans are well known and typically include one to five incandescent light sources. Fluorescent light sources have also been disclosed for use with ceiling fans. For example, U.S. Pat. No. 4,342,073 discloses a ceiling fan with illumination means mounted adjacent the motor housing and below the fan blades. The illumination means can be a plurality of incandescent lamps, or single circular fluorescent lamp. Similarly, U.S. Pat. No. 4,402,649 discloses a ceiling fan with an annular, circular fluorescent light bulb positioned around the ceiling fan motor, but above the rotating fan blades. Light is provided through an annular translucent panel surrounding the bulb and through decorative scroll work in the bottom panel below the bulb. Similarly, U.S. Pat. No. 4,831,505 discloses a circular fluorescent tube light fixture for a ceiling fan, wherein the circular tube is adjustably mounted below the ceiling fan so that it can be moved up and down, to match the type of reflector used.

U.S. Pat. No. 5,072,341 discloses a lamp assembly suspended from a ceiling fan, including several straight fluorescent lamps extending radially from the axis of the fan.

It is an object of the present invention to overcome the several disadvantages of the prior art, and to provide a ceiling fan room heater which effectively and comfortably heats an enclosed space in cool and cold weather and which can be used in a conventional manner to circulate the air and ventilate the enclosed space in warm and hot weather. An important object of this invention is to provide a ceiling fan room heater which delivers heat quietly. It is a further object of the present invention to provide a heating/lighting assembly adapted for mounting on an existing ceiling fan to provide heat and/or illumination in an efficient, effective and comfortable manner. It is also an object of this invention to provide for an existing ceiling fan a heating/lighting assembly which can be easily installed on the ceiling fan. Another object of the present invention is to provide a heating/lighting assembly for a ceiling fan which is unobtrusive, and which can be matched to the style and finish of the ceiling fan.

SUMMARY OF THE INVENTION

The present invention provides a ceiling fan equipped with a heating/lighting assembly which effectively and comfortably heats an enclosed space in cool and cold weather. The present invention includes a ceiling fan assembly comprising a plurality of radially extending fan blades and ceiling fan motor adapted for operation at a low rotational speed to circulate air within a room, and a heating/lighting assembly. The ceiling fan with heating/lighting assembly can be factory assembled and provided as a unit to the consumer. Alternatively, the heating/lighting assembly itself can be provided as an optional accessory for the purchaser of a new ceiling fan or as an add-on for a ceiling fan which had been previously installed. In this case the heating/lighting assembly is preferably adapted to be installed as a substitute for a conventional ceiling fan lighting kit.

The ceiling fan of the present invention includes a ceiling fan assembly and a heating/lighting assembly. The ceiling fan assembly comprises a plurality of radially extending fan blades rotating about a common axis and a ceiling fan motor adapted for operation at low rotational speed to circulate air within a room. The heating/lighting assembly comprises a generally circular housing in radial alignment with the ceiling fan assembly, and spaced radially outwardly of the ceiling fan motor. The heating/lighting assembly further includes means for mounting the housing below the fan blades, as well as at least one lighting means or lamps positioned in the housing, and at least one resistive heating element mounted in the housing. The housing is preferably adapted to serve as a reflector for the lighting means.

Preferably, the housing and the heating elements positioned therein are placed to maximize air flow over the housing and thus heat dissipation. Preferably, when the fan blades extend a distance B from the axis of rotation, the resistive electrical heating elements are spaced a distance A from the axis of rotation; such that the ratio of A to B is from about 1:1.5 to 1:2.

An annular housing is preferred. The housing can open downwardly to reflect light from the lighting means generally downwardly. Preferably, the lighting means is a circular fluorescent light tube, but incandescent bulbs can also be used, and an additional, central, light source can be provided. The resistive electrical heating elements are preferably PTC-type (positive temperature coefficient) elements. Alternatively, metal film-type elements can be used, or conventional "stove" type elements. Preferably, the housing includes means for dissipating heat from the heating element, such as slots, fins, or the like, so as to increase the surface area, and can be die-cast from a suitable material. The means for mounting the housing can also include means for dissipating heat from the heating elements. A temperature control responsive to the ambient temperature can also be provided..

The present invention also provides a heating/lighting assembly adapted for mounting on a ceiling fan. The heating/lighting assembly includes:

a) a generally circular housing in radial alignment with the ceiling fan assembly, and spaced radially outwardly of the ceiling fan motor;

b) means for mounting the housing below the fan blades;

c) a least one lighting means positioned in the housing;

d) at least one resistive heating element mounted in the housing.

The present invention overcomes the various disadvantages of the prior art and advantageously provides a heating assembly adapted for mounting on an existing ceiling fan to quietly provide heat and light in an efficient, effective and comfortable manner. The heating/lighting assembly of the present invention can be easily installed on an existing ceiling fan, and can be used instead of conventional lighting accessory kits.

BRIEF DESCRIPTION OF THE FIGURES

FIG. 1 is an elevational view of a presently preferred embodiment of a ceiling fan equipped with a heating/lighting assembly according to the present invention.

FIG. 2 is a bottom plan view of the ceiling fan equipped with a heating/lighting assembly of FIG. 1.

FIG. 3*a* is a sectional, elevational view of the ceiling fan equipped with a heating/lighting assembly of FIG. 1 taken along the line 3—3.

FIG. 3*b* is a sectional, elevational view of the ceiling fan equipped with a heating/lighting assembly of an alternative embodiment of the present invention taken along the line 3—3.

FIG. 4 is a fragmentary top plan view of a second alternative embodiment of the present invention.

DETAILED DESCRIPTION OF THE PREFERRED EMBODIMENTS

Referring now to the drawings, in which like reference numerals identify like elements throughout the several views, there is shown in FIG. 1 an elevational view of a presently preferred embodiment of a ceiling fan equipped with a heating/lighting assembly 10 according to the present invention.

As shown in the partially sectional view of FIG. 1, the ceiling fan 10 is mounted in a conventional manner to an electrical box 12 fixed in the ceiling 14 of an enclosed space to be heated. A pre-existing electrical box 12 positioned near the center of the ceiling 14 for an overhead light can be employed, provided the box 12 is mechanically secure. The box 12 can include box cover 16 to which is affixed a conventional light fixture mounting rod 18, to which the ceiling fan 10 can be secured.

The ceiling fan 10 includes a ceiling fan assembly 20 and a heating/lighting assembly 30. The ceiling fan assembly 20 includes a central motor housing 22 enclosing a conventional low speed electrical motor 23 from which are suspended a plurality, typically four, five or six, of fan blades 24, only two of which are shown in FIG. 1 for clarity, and which rotate about a central axis 21. Each blade 24 can include a decorative metal stem 25 which is often finished to have a bright or antique metallic appearance matching that imparted to the ceiling fan motor housing 22. Each stem 25 mounts a corresponding wooden paddle 26 to the ceiling fan motor's rotor (not shown).

In one aspect of the present invention, the ceiling fan assembly 20 comprises a pre-existing, previously installed ceiling fan of the type adapted to receive a light kit. In this type of ceiling fan a mounting rod 28 and electrical power connector (not shown) for the light kit are provided by the manufacturer of the ceiling fan. The mounting rod 28 and power connector are often provided by the manufacturer of the ceiling fan inside a small drum shaped housing (not shown) and concealed by small cover (not shown) in the center of the ceiling fan under the fan blades 24. The cover is easily removed for access to the mounting rod 28 and power connector. In this aspect of the present invention, a heating/lighting assembly 30 is provided for installation by the consumer or an electrician. In another aspect of the invention, the ceiling fan 10, including both the ceiling fan assembly 20 and the heating/lighting assembly 30 is provided as a unit completely or at least partially assembled by the manufacturer.

As best seen in FIG. 1, the heating assembly 30 includes a generally drum-shaped connector housing 32 preferably formed from metal and finished to match the ceiling fan motor housing 22 and the decorative stems 25 of the fan blades 24. The connector housing 32 is adapted to securely mount the heating/lighting assembly 30 on and to the ceiling fan assembly 20 by means of the threaded light kit mounting rod 28. A pair of insulated wire conductors (not shown) extend from the ceiling fan assembly 20 down through the light kit mounting rod 28 to provide electrical power to the heating/lighting assembly 30. In addition, a second pair of insulated wire conductors (not shown) for control of the ceiling fan motor 23 also extend down through the light kit mounting rod 28 to the heating/lighting assembly 30.

The heating/lighting assembly 30 also includes a generally circular lamp housing 40 in radial alignment with the rotational axis 21 of the ceiling fan assembly 20 and spaced radially outwardly of the motor 23. Preferably, the lamp housing 40 has an annular configuration, and opens downwardly to reflect light generally downwardly. However, a lamp housing opening upwardly, to provide the room with indirect light reflected by the ceiling, can also be employed (not shown).

The heating/lighting assembly 40 also includes means 42 for mounting the housing 40 below the fan blades 24. As best seen in the bottom plan view of FIG. 2, the housing mounting means 42 includes a plurality of legs 44 extending between the connector housing 32 and the lamp housing 40, and preferably formed from a heat-conducting material such as metal, and preferably provided with a large, heat-dissipating surface area adapted to permit good air circulation, such as by perforating and slotting the legs as represented in the figures. Alternatively, the lamp housing 40 and housing support 42 can be combined in a single plate-like unit (not shown). The lamp housing 40 itself is preferably formed from a heat-conducting material, such as a die-cast metal, and is shaped to provide a large heat dissipating surface area, as by providing a plurality of slots 46, and/or fins 48 (FIGS. 3*b*, 4), which may take on decorative shapes such as geometric or artistic figures (not shown) or natural forms such as leaves (FIG. 4), animals, waves, and the like (not shown). The fins 48 can extend from the sides (FIG. 4) or top (FIG. 3*b*) of the lamp housing 40, or both.

The heating/lighting assembly 30 further includes at least one lighting means 50 or lamp positioned in the lamp housing 40. The lamp 50 is preferably a circular fluorescent light tube, secured and electrically connected to a conventional fluorescent electrical socket 52 mounted on the bottom of the lamp housing 40, and supported by a plurality of clips 54, with power being supplied to the lamp 50 via a first power line 56 running under one of the legs 44 from a ballast 58 positioned in the connector housing 32 to the electrical socket 52. The ballast 58 can be an electronic type ballast or a core and coil-type ballast. Alternatively, conventional incandescent lamps, or their energy saving fluorescent substitutes, can be installed in the lamp housing 40 in a plurality of conventional lamp sockets (not shown).

The heating/lighting assembly 30 also includes at least one resistive heating element 60 mounted in the lamp housing 40, as best seen in the cross-sectional views of FIGS. 3*a* and 3*b*. The resistive heating element 60 can be of the PCT-type, a conventional "stove"-type resistance element, or the thin-film type, in which the conducting film is sandwiched between a pair of insulative sheets, formed from a high temperature resistant synthetic plastic material. In the latter case, the resistive heating element 60 can be mounted inside the lamp housing, such as shown in FIG. 3*a*. A second power line 62 (FIG. 2) extends along a leg 44 between heat control circuitry (not shown) in the connector housing 32 and the lamp housing 40 to provide power to the heating element 60. In this embodiment, the lower or inside surface of the lamp housing 40 is preferably painted white, or is otherwise provided with a shiny, reflective surface to reflect light from the lamp 50 and direct it downward.

Alternatively, as shown in FIG. 3*b*, the heating elements 60 are mounted on the bottom side of the housing 40. Preferably, the housing 40 also includes a polished, shiny reflector 65 for the lamp 50, positioned between the heating elements 60 and the lamp 50, to reflect light from the lamp 50 downward.

In order to provide for maximum heat transfer, the heating element 60 is spaced from the axis of rotation 21 of the ceiling fan. Optimally, where the fan blades 24 extend a distance B from the axis of rotation 21 (FIG. 1), and the heating element 60 is spaced a distance A from the axis of rotation 21, the ratio A:B is from about 1:1.5 to 1:2.

The speed at which the ceiling fan blades 24 rotate is controlled by a switch 64 positioned inside the connector housing 32, which also contains a control switch 66 for the lamp 50 and a control switch for the heating element 60 (not shown), all of which are controlled by an operator through a plurality of conventional pull chains or cords, 68. Alternatively, the various functions of the ceiling fan equipped with a heating/lighting assembly 10 can be actuated electronically by remote control (not shown) through an infrared-type control device or the like.

A conventional additional lighting means 70 or lamp can be provided on the connector housing 32. For example, the additional lighting means 70 can be a conventional incandescent lamp when a circular fluorescent lamp mounted in the circular lamp housing 40, to provide a broader spectrum light.

Various modifications can be made in the details of the various embodiments of the apparatus of the present invention, all within the scope and spirit of the invention and defined by the appended claims.

What is claimed is:

1. A ceiling fan equipped with a heating/lighting assembly, the ceiling fan comprising:

a) a ceiling fan assembly comprising a plurality of radially extending fan blades and a ceiling fan motor adapted for operation at low rotational speed to circulate air within a room, the ceiling fan assembly having an axis of rotation, and b) a heating/lighting assembly comprising 1) a generally circular housing in radial alignment with the ceiling fan assembly, and spaced radially outwardly of the ceiling fan motor;

2) means for mounting the housing below the fan blades;

3) a least one lighting means positioned in the housing;

4) at least one resistive heating element mounted in the housing.

2. A ceiling fan according to claim 1 wherein a) the fan blades extend a distance B from the axis of rotation:

b) the resistive electrical heating element is spaced a distance A from the axis of rotation; and c) the ratio of A to B is from about 1:1.5 to 1:2.

3. A ceiling fan according to claim 1 wherein the housing is annular and opens downwardly to reflect light from the lighting means generally downwardly.

4. A ceiling fan according to claim 1 wherein the lighting means is a circular fluorescent light tube.

5. A ceiling fan according to claim 1 wherein the at least one resistive heating element comprises a PTC-type element.

6. A ceiling fan according to claim 1 wherein the at least one resistive heating element comprises a metal film-type element.

7. A ceiling fan according to claim 1 wherein the housing comprises means for dissipating heat from the heating element.

8. A ceiling fan according to claim 1 wherein the means for mounting the housing includes means for dissipating heat from the heating element.

9. A ceiling fan according to claim 1 wherein the heating/lighting assembly further comprises temperature control means responsive to the ambient temperature.

10. A ceiling fan according to claim 1 further comprising at least one lighting means positioned on the axis of rotation.

11. A heating/lighting assembly adapted for mounting on a ceiling fan assembly, the ceiling fan assembly comprising a plurality of radially extending fan blades and a ceiling fan motor adapted for operation at low rotational speed to circulate air within a room, the ceiling fan assembly having an axis of rotation, the heating/lighting assembly comprising:

a) a generally circular housing in radial alignment with the ceiling fan assembly, and spaced radially outwardly of the ceiling fan motor;

b) means for mounting the housing below the fan blades;

c) a least one lighting means positioned in the housing;

d) at least one resistive heating element mounted in the housing.

12. A heating/lighting assembly according to claim 11 wherein a) the fan blades of the ceiling fan assembly extend a distance B from the axis of rotation:

b) the resistive electrical heating element is spaced a distance A from the axis of rotation; and c) the ratio of A to B is from about 1:1.5 to 1:2.

13. A heating/lighting assembly according to claim 11 wherein the housing is annular and opens downwardly to reflect light from the lighting means generally downwardly.

14. A heating/lighting assembly according to claim 11 wherein the lighting means is a circular fluorescent light tube.

15. A heating/lighting assembly according to claim 11 wherein the at least one resistive heating element comprises a PTC-type element.

16. A heating/lighting assembly according to claim 11 wherein the at least one resistive heating element comprises a metal film-type element.

17. A heating/lighting assembly according to claim 11 wherein the housing comprises means for dissipating heat from the heating element.

18. A heating/lighting assembly according to claim 11 wherein the means for mounting the housing includes means for dissipating heat from the heating element.

19. A heating/lighting assembly according to claim 11 wherein the heating/lighting assembly further comprises temperature control means responsive to the ambient temperature.

20. A heating/lighting assembly according to claim 11 further comprising at least one lighting means positioned on the axis of rotation.

* * * * *